United States Patent [19]

Nakamura et al.

[11] Patent Number: 4,870,931

[45] Date of Patent: Oct. 3, 1989

[54] ROCKER ARM HAVING WEAR RESISTANT SCUFFING RESISTANT PORTION

[75] Inventors: Yoshikatsu Nakamura, Omiya; Osamu Kawamura, Urawa; Souichi Shimomura, Yono, all of Japan

[73] Assignee: Nippon Piston Ring Co., Ltd., Tokyo, Japan

[21] Appl. No.: 198,250

[22] Filed: May 25, 1988

[30] Foreign Application Priority Data

May 30, 1987 [JP] Japan ..... 62-133489

[51] Int. Cl.[4] ..... F01L 1/18; F01L 1/16

[52] U.S. Cl. ..... 123/90.39; 123/90.51

[58] Field of Search ..... 123/90.39, 90.51

[56] References Cited

U.S. PATENT DOCUMENTS 2,963,011 12/1960 Davis et al. ..... 123/90.51
4,360,383 11/1982 Takahashi et al. ..... 75/236

FOREIGN PATENT DOCUMENTS 2747757 11/1978 Fed. Rep. of Germany ... 123/90.39
56-129710 10/1981 Japan .
1111290 4/1968 United Kingdom .
1196865 7/1970 United Kingdom ..... 123/90.39
2073247 10/1981 United Kingdom ..... 123/90.51

*Primary Examiner*—Charles J. Myhre
*Assistant Examiner*—Weilun Lo
*Attorney, Agent, or Firm*—Oliff & Berridge

[57] ABSTRACT

A rocker arm for use in an internal combustion engine. The rocker arm has a portion abutting an opponent mechanical component, and at least the portion is formed of a cast iron consisting of from 2.5 to 3.7 wt % of carbon; from 1.0 to 2.0 wt % of silicon; from 0.5 to 1.0 wt % of manganese; from 10 to 20 wt % of chromium; from 0.3 to 0.7 wt % of nickel; not more than 0.3 wt % of phosphorus; not more than 0.1 wt % of sulfur; and balance iron and impurities; Carbide mainly containing chromium is uniformly precipitated from at least one of pearlitic and martensitic matrix in the cast iron.

2 Claims, 2 Drawing Sheets

ROCKER ARM HAVING WEAR RESISTANT SCUFFING RESISTANT PORTION

BACKGROUND OF THE INVENTION

The present invention relates to a rocker arm for use in an internal combustion engine, and more particularly, to the rocker arm provided with a cast iron member having high wear resistance and scuffing resistance at least at a pad or abutting portion. The pad portion may be an upper rocker arm portion in sliding contact with a rotating cam lobe of a camshaft or a lower tip end portion in abutment with an upper valve stem end or in slide contact with a rotating cam lobe.

As shown in FIGS. 1 and 2, there are several types of rocker arms, such as a pivot type rocker arm (FIG. 1) and a rocker shaft type rocker arm (FIG. 2). The former type is generally adopted in an OHC engine, and in which a rocker arm body 1 has one end 1*a* pivotally supported to a spherical portion of a pivot member 2, and another end portion 1*b* provided with a lower surface portion 1*d* (pad portion) in abutment with an upper end of a valve stem 3. A cam lobe 4*a* of a camshaft 4 is in rotational contact with an upper surface portion (another pad portion) 1*c* of the rocker arm body 1, so that the lower surface portion 1*d* urges the valve stem 3 in its axial direction upon rotation of the cam lobe 4*a*. In case of the rocker shaft type shown in FIG. 2, a rocker arm 1' is pivotally supported by a rocker shaft 5. One end (pad portion) 1*a'* of the rocker arm is in contact with a rotating cam lobe 4*a*, while another end portion (another pad portion) 1*b'* is in contact with an upper valve stem end 3. Upon rotation of the cam lobe 4, the rocker arm body 1*a'* is pivotted about the rocker shaft 5 to urge the valve stem 3.

With the structure, the pad portions 1*c*, 1*d* and 1*a'* of the rocker arms abut these opponent components such as the cam lobe 4*a* and the valve stem 3 at relatively high pressure. Therefore, these portions must provide high wear resistance. In this connection, conventionally, the rocker arm body in its entirety or at least these pad portions thereof is formed of chilled iron, cast steel or sintered alloy.

In case the sintered alloy chip is incorporated to the pad portions, it is fixed to the rocker arm body formed of cold forging steel by brazing or burning. However, such unitary structure lead to high production cost. Further, if the chilled iron or cast steel chip is used as a wear resistant chip member at the abutting portions, the chip undergoes excessive frictional wear in use under high performance high load engines those being up-to-date demands.

On the other hand, known is 28%Cr cast iron which exhibits sufficient wear resistant property because of its inclusion of carbide having high hardness such as $(Cr.Fe)_7C_3$. However, in this cast iron, ferrite may be precipitated, and therefore, sufficient wear resistivity would not be obtainable if such cast iron material is used in the rocker arm which is operated in association with a high speed high load engine.

Japanese laid open patent application, Kokai No. 56-129710 discloses a rocker arm in which several portions in abutment with the camshaft and the valve stem are formed of cast iron containing from 5 to 36 % of Cr, and abutting surfaces of the cast iron piece are subjected to nitriding treatment. The present invention is an improvement on the rocker arm abutting portion by providing specific combinations of compositions and their percentages taking also metallic structure of the cast iron into consideration.

SUMMARY OF THE INVENTION

It is therefore an object of this invention to overcome the above-described drawbacks and deficiencies, and to provide an improved rocker arm having sufficient wear and scuffing resistances.

Another object of this invention is to provide such rocker arm having sufficient performance capable of withstanding severe condition under high speed high load engine operation.

Briefly, according to this invention, there is provided a rocker arm for use in an internal combustion engine having a portion abutting an opponent mechanical component, and at least the portion being formed of a cast iron consisting of from 2.5 to 3.7 wt % of carbon; from 1.0 to 2.0 wt % of silicon; from 0.5 to 1.0 wt % of manganese; from 10 to 20 wt % of chromium; from 0.3 to 0.7 wt % of nickel; not more than 0.3 wt % of phosphorus; not more than 0.1 wt % of sulfur; and balance iron and impurities. Carbide mainly containing chromium is uniformly precipitated from at least one of pearlitic and martensitic matrix in the cast iron.

In this invention, there is also provided a rocker arm for use in an internal combustion engine having a portion abutting an opponent mechanical component, and at least the portion being formed of a cast iron consisting of from 2.5 to 3.7 wt % of carbon; from 1.0 to 2.0 wt % of silicon; from 0.5 to 1.0 wt % of manganese; from 10 to 20 wt % of chromium; from 0.3 to 0.7 wt % of nickel; from 1 to 10 wt % of at least one component selected from tungsten, molybdenum, vanadium, niobium and tantalum; not more than 0.3 wt % of phosphorus; not more than 0.1 wt % of sulfur; and balance iron and impurities. Carbide mainly containing chromium is uniformly precipitated from at least one of pearlitic and martensitic matrix in the cast iron.

DETAILED DESCRIPTION OF THE INVENTION

Figure 1:
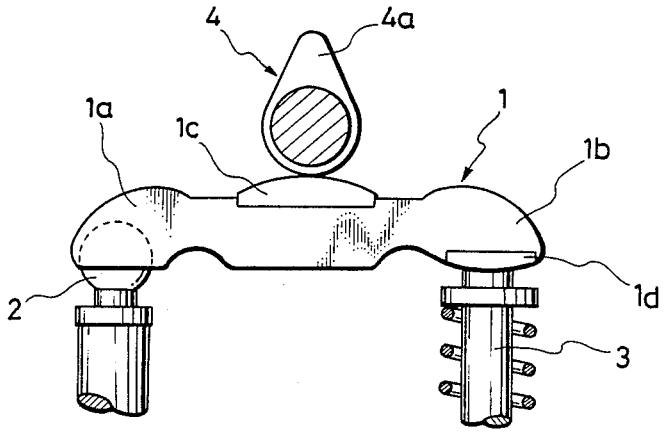
FIG. 1 is a side view showing a pivot type rocker arm arrangement.

A chip or chips formed of an inventive cast iron in abutment with a camshaft or a valve stem end is subjected to brazing or round-casting with respect to a rocker shaft body formed of steel or aluminum for providing a unitary structure. However, shell mold process or lost wax process is more preferable to reduce production cost at low level. Further, the cast iron material provides pearlitic matrix at as-cast state which exhibits sufficient wear resistance. However, more improved wear resistivity is obtainable by hardening or nitriding after hardening. By the hardening treatment, obtainable are hardened martensitic matrix or composite pearlitic and martensitic matrix, and by the nitriding treatment a nitride layer is formed at a surface of the cast iron body.

Next, details of the compositions in the cast iron will be described.

Carbon C is solid-solved in a matrix to strengthen the same. Further, carbon forms hard carbide mainly containing Cr such as $(Cr\ Fe)_7C_3$ or other types of carbides, to thereby improve wear resistance. If the carbon amount is less than 2.5 wt %, carbide precipitation amount is insufficient to thereby lower the wear resistance. If the carbon amount exceeds 3.7 wt %, carbide is excessively precipitated, so that machinability is lowered and an opponent member will be damaged.

Silicon Si is added as inoculant. If silicon amount is less than 1.0 wt %, melting point of a molten metal becomes high, to thus degrade fluidity thereof during casting. If the amount exceeds 2.0 wt %, carbide formation is restrained and graphite is precipitated, thereby to lower the wear resistance.

Manganese Mn partly forms carbide, and part of the manganese is solid-solved in a matrix to promote formation of pearlite, and promote hardening property. If Mn amount is less than 0.5 wt %, these effects may not be attainable. If the amount exceeds 1.0 wt %, carbide is excessively precipitated, or generated is temper-brittleness around carbide in martensitic matrix so that embrittlement of an entire cast iron results.

Chromium Cr is solid-solved in a matrix to strengthen the latter and to enhance heat and corrosion resistances. In the present invention great amount of Cr is contained in the cast iron, so that carbide containing great amount of Cr is provided such as $(Cr\ Fe)_7C_3$ which has high wear resistance because of its high hardness. If Cr amount is less than 10 wt %, precipitation amount of carbide is lowered, which lead to deficient wear resistivity. On the other hand, if Cr amount exceeds 20 wt %, ferritic matrix results to thus also degrade wear resistivity.

Nickel Ni provides dense matrix, and permits the same to be strengthened. Further, Ni improves hardening effect. If Ni amount is less than 0.3 wt %, these effect may not be obtainable, and if the amount exceeds 0.7 wt %, such effect cannot be improved any more and therefore production cost will be increased.

Phosphorus P is added by not more than 0.3 wt %, and sulfur is added by not more than 0.1 wt %. If addition amounts exceed these, resultant cast iron becomes brittle.

Remaining compositions are iron Fe and impurities to form the cast iron to be used as entire rocker arm or pad members provided at abutting portions of the rocker arm. In as-cast state, pearlitic matrix is provided. If further hardened, martensitic matrix is provided. Furthermore, nitriding treatment can be effected to the hardened cast iron body for surface hardening. As a result, excellent sliding properties with respect to the cam lobe or valve stem end are obtainable.

In order to further enhance wear resistance depending on working condition of the rocker arm with respect to the opponent members, from 1 to 10 wt % of carbide forming element is added. At least one of the carbide forming element is selected from tungsten W, molybdenum Mo, vanadium V, niobium Nb, and tantalum Ta. If the amount of the element is less than 1 wt %, no improvement occurs in wear resistance, whereas if the amount exceeds 10 wt %, resultant cast iron becomes economically unsuccessful.

EXAMPLE

Prepared were twelve samples (sample Nos. 1 thru 12 in a Table 1 below) according to the present invention, and four samples (sample Nos. 13 thru 16 in the Table) as comparative samples. Among the samples 1 thru 12, compositions and their percentiles were changed from one another, and in the comparative samples several compositions had their percentages outside the claimed range. Such compositions are allotted with * marks in Table 1.

Figure 2:
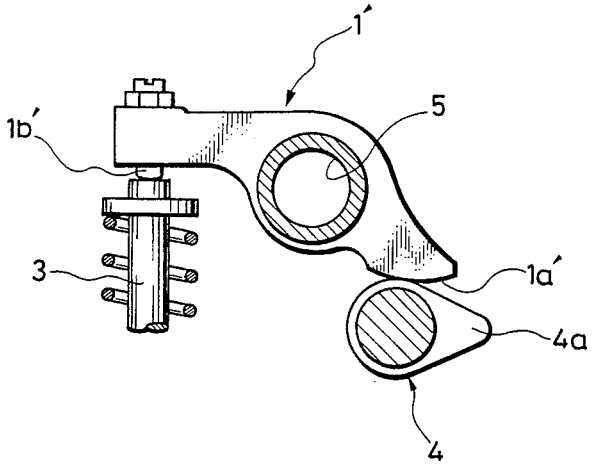
FIG. 2 is a side view showing a rocker shaft type rocker arm arrangement.

The compositions thus prepared for making the rocker arms were casted at a temperature ranging from 1450° to 1550° C. in a lost wax mold to provide the rocker shaft type rocker arms shown in FIG. 2. Several samples were as-cast samples, and remaining samples were subjected to oil-hardening at a temperature of 900° C. for 60 minutes. Further, salt-bath soft nitriding was effected to several samples of the remaining samples at a temperature of 580° C. for 90 minutes. Such treatments are shown in Table 1.

To these samples, investigated were matrix structure, hardness of the matrix and durability. Matrix structure were microscopically observed. In hardness tests, the hardness of the matrix was tested at Rockwell hardness (HRC), and hardness of the nitride layer was tested at Vickers hardness(HV). In the durability test, each of the rocker arm samples was assembled in four-cylinder OHC engine. The rocker arm sample was in camming contact with a cam lobe of a camshaft formed of cast iron. A chilled iron was used at a nose portion of the cam lobe. The camshaft consisted of 3.3 wt % of C, 2.2 wt % of Si, 0.75 wt % of Mn, 0.18 wt % of P, 0.06 wt % of S, 0.21 wt % of Cu, 0.85 wt % of Cr, 0.19 wt % of Mo, 0.04 wt % of B, and balance Fe and impurities. Lubrication oil of SAE10W was supplied to the abutting portion between the cam lobe and the rocker arm. The engine speed was 1000 r.p.m. After 200 hours testing, investigated were wear amounts at the pad portions (testing samples) of the rocker arms and the opponent nose portions of the cam lobes. These wear amounts are also shown in Table 1.

TABLE 1

| TESTING SAMPLES | | COMPOSITION (wt %) | | | | | | | | | | | |
|---|---|---|---|---|---|---|---|---|---|---|---|---|---|
| | No. | C | Si | Mn | Cr | Ni | P | S | Nb | W | V | Mo | Ta | Fe |
| According to this Invention | 1 | 2.75 | 1.50 | 0.75 | 12.5 | 0.52 | 0.21 | 0.06 | — | — | — | — | — | Balance |
| | 2 | 3.49 | 1.51 | 0.75 | 17.9 | 0.51 | 0.21 | 0.06 | — | — | — | — | — | Balance |
| | 3 | 2.98 | 1.48 | 0.70 | 13.0 | 0.45 | 0.18 | 0.06 | — | — | — | — | — | Balance |
| | 4 | 2.98 | 1.48 | 0.70 | 13.0 | 0.45 | 0.19 | 0.08 | — | — | — | — | — | Balance |
| | 5 | 3.49 | 1.51 | 0.75 | 17.9 | 0.51 | 0.21 | 0.06 | — | — | — | — | — | Balance |
| | 6 | 3.49 | 1.51 | 0.75 | 17.9 | 0.51 | 0.21 | 0.06 | — | — | — | — | — | Balance |
| | 7 | 3.55 | 1.51 | 0.75 | 17.9 | 0.51 | 0.21 | 0.06 | 2.02 | — | — | — | — | Balance |
| | 8 | 3.55 | 1.20 | 0.55 | 18.5 | 0.32 | 0.21 | 0.06 | 2.02 | 5.03 | — | — | — | Balance |
| | 9 | 3.55 | 1.20 | 0.55 | 18.5 | 0.32 | 0.21 | 0.06 | 2.02 | 3.45 | — | — | — | Balance |

TABLE 1-continued

| | | | | | | | | | | | | | | |
|---|---|---|---|---|---|---|---|---|---|---|---|---|---|---|
| | 10 | 3.60 | 1.51 | 0.75 | 17.9 | 0.51 | 0.21 | 0.06 | — | 5.05 | — | 1.03 | — | Balance |
| | 11 | 3.60 | 1.51 | 0.75 | 18.0 | 0.50 | 0.21 | 0.05 | — | — | 2.05 | — | — | Balance |
| | 12 | 3.65 | 1.50 | 0.90 | 18.6 | 0.60 | 0.20 | 0.05 | — | — | — | — | 3.05 | Balance |
| Comparative | 13 | 2.31* | 1.62 | 0.72 | 9.02* | 0.51 | 0.23 | 0.06 | — | — | — | — | — | Balance |
| Samples | 14 | 2.31* | 1.62 | 0.72 | 9.02* | 0.51 | 0.23 | 0.06 | — | — | — | — | — | Balance |
| | 15 | 3.80* | 1.50 | 0.73 | 21.0* | 0.63 | 0.21 | 0.05 | — | — | — | — | — | Balance |
| | 16 | 3.42 | 1.47 | 0.75 | 28.2* | 0.30 | 0.20 | 0.05 | — | — | — | — | — | Balance |

| | TESTING SAMPLES No. | Surface Treatment | Matrix Structure | Matrix Hardness (HRC) | Nitride Layer Hardness (HV) | Rocker Arm Wear Amount (μm) | Cam Wear Amount (μm) |
|---|---|---|---|---|---|---|---|
| According | 1 | — | P | 42 | — | 65 | 52 |
| to this | 2 | — | P | 49 | — | 61 | 54 |
| Invention | 3 | Hardening | M | 62 | — | 51 | 146 |
| | 4 | Nitriding | M | 50 | 1280 | 29 | 71 |
| | 5 | Hardening | M | 65 | — | 44 | 111 |
| | 6 | Nitriding | M | 52 | 1320 | 23 | 65 |
| | 7 | Hardening | M | 63 | — | 50 | 120 |
| | 8 | Hardening | M | 67 | — | 36 | 155 |
| | 9 | Nitriding | M | 55 | 1350 | 22 | 63 |
| | 10 | Hardening | M | 67 | — | 32 | 131 |
| | 11 | Hardening | M | 65 | — | 71 | 128 |
| | 12 | Hardening | M | 67 | — | 68 | 133 |
| Comparative | 13 | Hardening | M | 59 | — | 132 | 265 |
| Samples | 14 | Nitriding | M | 49 | 1180 | 92 | 133 |
| | 15 | Hardening | P ÷ F | 54 | — | Scuffing | |
| | 16 | Hardening | P ÷ F | 55 | — | Scuffing | |

As is apparent from Table 1, according to the comparative samples, at least one of the test sample and the opponent member was greatly worn out, and sample Nos. 15 and 16 incurred scuffing. On the other hand, according to the samples of the present invention, only a small amount of wear were provided in the testing samples as well as in the cam lobe.

Turning to hardness of the matrix, not less than HRC62 was obtained if hardening was effected in the present invention. If nitriding is further conducted, the hardness of the matrix was lowered to not less than HRC50 due to softening of the matrix. However, nitride surface layer provided hardness of not less than HV1250, which hardness is far greater than the hardness of the matrix. Incidentally, regarding sample Nos. 4, 6 and 9, Vickers hardness were 1280, 1320 and 1350, respectively, whereas wear amount of the cam lobes were 71 μm, 65 μm and 63 μm, respectively. These hardness-wear relationship between the test pieces and the cam lobes appears to be contradictory at first glance (high hardness member is considered to cause large wear in the opponent member). However, this is not the case in the present invention. That is, attention should be also drawn to coefficient of friction. Nitride layer in the pad portion provides good compatibility with respect to the opponent cam lobe, so that such test result occurred.

Regarding matrix structure, pearlite, martensite and ferrite are represented by P, M and F, respectively in Table 1. Further, P+F stands for coexistance of pearlite and ferrite.

Figure 3:
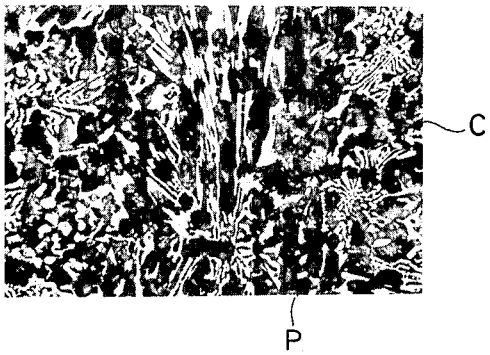
FIG. 3 is a microscopic photograph at magnification of 400 times (surface view) showing one example of a cast iron used in a rocker arm according to this invention.

Sample No. 2 is shown in microscopic photograph in FIG. 3 at magnification of 400 times. The sample underwent etching treatment with niter reagent. According to the matrix structure, carbide C (white portion) is uniformly distributed in pearlitic matrix P (black portion).

Figure 4:
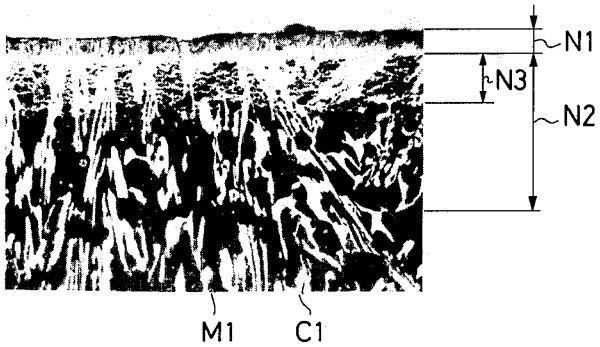
FIG. 4 is a cross-sectional microscopic photograph at the magnification showing another example of a cast iron used in a rocker arm of this invention; and, FIG. 5 is a microscopic photograph at the magnification showing still another example of a cast iron used in a rocker arm of this invention.

Cross-sectional view of the sample No. 4 is shown microscopically in FIG. 4. Magnification and treatment are the same as those of sample No. 2. According to this photograph, a nitride layer N1 having a thickness of about 13 μm is formed, and nitrogen diffusion layer N2 having thickness of about 90 μm is formed below the nitride layer N1. In the upper portion of the nitrogen diffusion layer N2, stitch like nitride N3 can be observed. Further, below the nitrogen diffusion layer N2 and in the base portion, martensitic matrix M1 (black portion) and carbide C1 (white portion) are observed.

Figure 5:
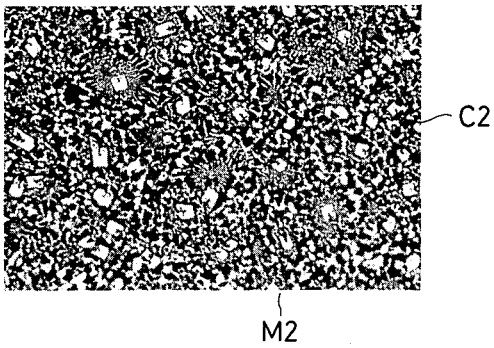

Sample No. 10 is shown microscopically in FIG. 5 in which magnification and etching treatment are the same as those of the sample No. 2. In this photograph, carbide C2 (white portion) is uniformly dispersed in martensitic matrix M2 (black portion). Fine carbide C is observed in comparison with the carbide C2 of sample No. 2 because of the addition of W and Mo in sample No. 10.

In view of the foregoing, the rocker arm according to the present invention exhibits sufficient wear resistance and scuffing resistance. The rocker arm of this invention is particularly available for the internal combustion engine operable at high speed and high load.

What is claimed is:

1. A rocker arm for use in an internal combustion engine, said rocker arm having a portion abutting an opponent mechanical component, at least said portion being formed of a cast iron consisting of from 2.5 to 3.7 wt % of carbon; from 1.0 to 2.0 wt % of silicon; from 0.5 to 1.0 wt % of manganese; from 10 to 20 wt % of chromium; from 0.3 to 0.7 wt % of nickel; not more than 0.3 wt % of phosphorus; not more than 0.1 wt % of sulfur; and balance iron and impurities; carbide mainly containing chromium being uniformly precipitated from at least one of pearlitic and martensitic matrix in said cast iron.

2. A rocker arm for use in an internal combustion engine, said rocker arm having a portion abutting an opponent mechanical component, at least said portion being formed of a cast iron consisting of from 2.5 to 3.7 wt % of carbon; from 1.0 to 2.0 wt % of silicon; from 0.5 to 1.0 wt % of manganese; from 10 to 20 wt % of chromium; from 0.3 to 0.7 wt % of nickel; from 1 to 10 wt % of at least one component selected from tungsten, vanadium, niobium and tantalum; not more than 0.3 wt % of phosphorus; not more than 0.1 wt % of sulfur; and balance iron and impurities; iron carbide mainly containing chromium being uniformly precipitated from at least one of pearlitic and martensitic matrix in said cast iron.

* * * * *